US006180326B1

(12) United States Patent
Poncelet

(10) Patent No.: US 6,180,326 B1
(45) Date of Patent: Jan. 30, 2001

(54) METHOD FOR THE DECONTAMINATION OF A PHOTOGRAPHIC BATH USING HEAT-REVERSIBLE POLYMER PARTICLES

(75) Inventor: Olivier C. Poncelet, Chalon sur Saone (FR)

(73) Assignee: Eastman Kodak Company, Rochester, NY (US)

( * ) Notice: Under 35 U.S.C. 154(b), the term of this patent shall be extended for 0 days.

(21) Appl. No.: 09/465,200

(22) Filed: Dec. 15, 1999

(30) Foreign Application Priority Data

Dec. 15, 1998 (FR) ..... 98 15963

(51) Int. Cl.[7] ..... G03C 5/31; G03C 5/395
(52) U.S. Cl. ..... 430/398; 430/399; 430/400
(58) Field of Search ..... 430/398, 399, 430/400

(56) References Cited

U.S. PATENT DOCUMENTS 3,497,467 2/1970 Coleman ..... 524/389
3,691,086 9/1972 Lees et al. ..... 516/142
4,144,373 3/1979 Weiss et al. ..... 428/306
5,219,717 6/1993 Schmittou et al. ..... 430/398
5,840,471 * 11/1998 Fukuwatari et al. ..... 430/398
5,972,567 * 10/1999 Poncelet et al. ..... 430/398

FOREIGN PATENT DOCUMENTS 1 450 588 9/1976 (GB) .

* cited by examiner

*Primary Examiner*—Hoa Van Le

(57) ABSTRACT

This invention concerns photographic processing, and specifically the decontamination of effluents from photographic processing.

This invention consists in placing the effluents in contact with a heat-reversible polymer in the form of hydrogel particles, for a long enough time for the polymer to adsorb the contaminants from the effluent, in then removing the heat-reversible polymer from the effluent, and in then cooling the heat-reversible polymer to extract the contaminants from it. This invention is useful for the elimination of tars that are formed in photographic baths during processing.

9 Claims, 1 Drawing Sheet

METHOD FOR THE DECONTAMINATION OF A PHOTOGRAPHIC BATH USING HEAT-REVERSIBLE POLYMER PARTICLES

TECHNICAL FIELD

This invention concerns the decontamination and the regeneration of photographic processing baths and more particularly a method to eliminate organic pollutants contained in photographic baths.

BACKGOUND OF THE INVENTION

Conventionally, silver halide photographic materials, after exposure, pass through successive photographic processing baths. For example, the processing of black-and-white photographic products comprises a black-and-white development step, a fixing step, and a washing step. The processing of color photographic products comprises a color development step, a bleaching step, a fixing step, (or a bleaching-fixing step), and a washing and/or stabilization step.

During the processing of these color photographic materials, the composition of the processing baths changes. In particular, the photographic baths accumulate chemicals such as gelatin, latex, polymers, surfactants, etc., or other organic substances which leak out from the photographic or are the result of reactions during development. All these substances pollute the baths and reduce their efficiency. In addition, the presence of these pollutants in the photographic processing baths causes not only a sensitometric impairment of the photographic products, but also fouling of the processing machine and thereby of the materials being processed. This fouling is especially troublesome because photographic materials are generally processed in automated processing machines. The machines that allow a rapid development of photographic materials are also those most rapidly fouled. In particular, in the photographic processing baths of these automated machines are formed tars derived from the constituents of the photographic materials, which settle on the photographic material during the processing, and foul the machine. The presence of these tars requires frequent cleaning of processing machines, earlier replenishment of the baths, and in extreme cases several washings of the photographic materials.

The prior art has recognized this problem has tried to solve it by adding surfactants to the baths during processing in order to help dissolving the tars formed. However, the large amounts of such surfactants that have to be added impair the stability and efficiency of the processing baths.

The accumulation in the washing and(or) stabilization baths of substances from preceding processing steps impairs the stability of the photographic images developed, adversely affects the sensitometric characteristics, and increases plant maintenance requirements. Because of this, it is difficult to recycle the washing and stabilization baths. It is also unsafe to discard them in sewage, because after processing, the washing and stabilization baths contain compounds that raise the COD values of these baths. For example, effluents can be treated by electrolytic oxidation, dialysis, reverse osmosis (as described in German patent application 3 246 897), flocculation, or oxidation with hydrogen peroxide, possibly combined with UV treatment, as described in the U.S. Pat. No. 5,439,599 of Gehin et al. A non-catalytic oxidation can also be combined with a catalytic oxidation and a biological treatment, as described in European patent application 690 025.

The treatments described in the literature mostly advocate associating two or more methods to achieve satisfactory decontamination of the effluent, so that it can be safely discarded, or to remove species that may hinder re-use of the effluent. Also, some of these methods are costly to implement.

To purify effluents, the use of heat-reversible polymers in the form of hydrogels has also been proposed, as described for example in European patent application 648 521. However, one of the known characteristics of heat-reversible polymers is that their transition temperatures can vary significantly according to the values of several parameters, in particular the presence of surfactants in the effluent, as reported by Y. Q. Zhang et al. in Langmuir 1995, 11, 2493-5. This variability of transition temperature is a drawback for routine use of these polymers to depollute photographic effluents, because these effluents almost always contain surfactants or substances possessing surfactant properties to some degree.

SUMMARY OF THE INVENTION

The object of this invention is to provide a further solution to the problem arising from the presence of organic substances and tars in photographic processing baths. It is desirable to devise a method that allows these substances and tars to be eliminated rapidly and at low cost, without adversely affecting the sensitometric characteristics of the photographic products processed, and without impairing the stability or the efficiency of the photographic processing baths.

Another object of the invention is to reduce the soiling of the automated processing machines, and thereby to reduce the frequency of maintenance operations on these machines.

These and other objects are achieved by the method of this invention, which consists in placing a photographic bath containing organic pollutants and tars in contact with photographically inert heat-reversible polymer particles that are resistant to high pH values.

DETAILED DESCRIPTION OF THE INVENTION

Figure 1:
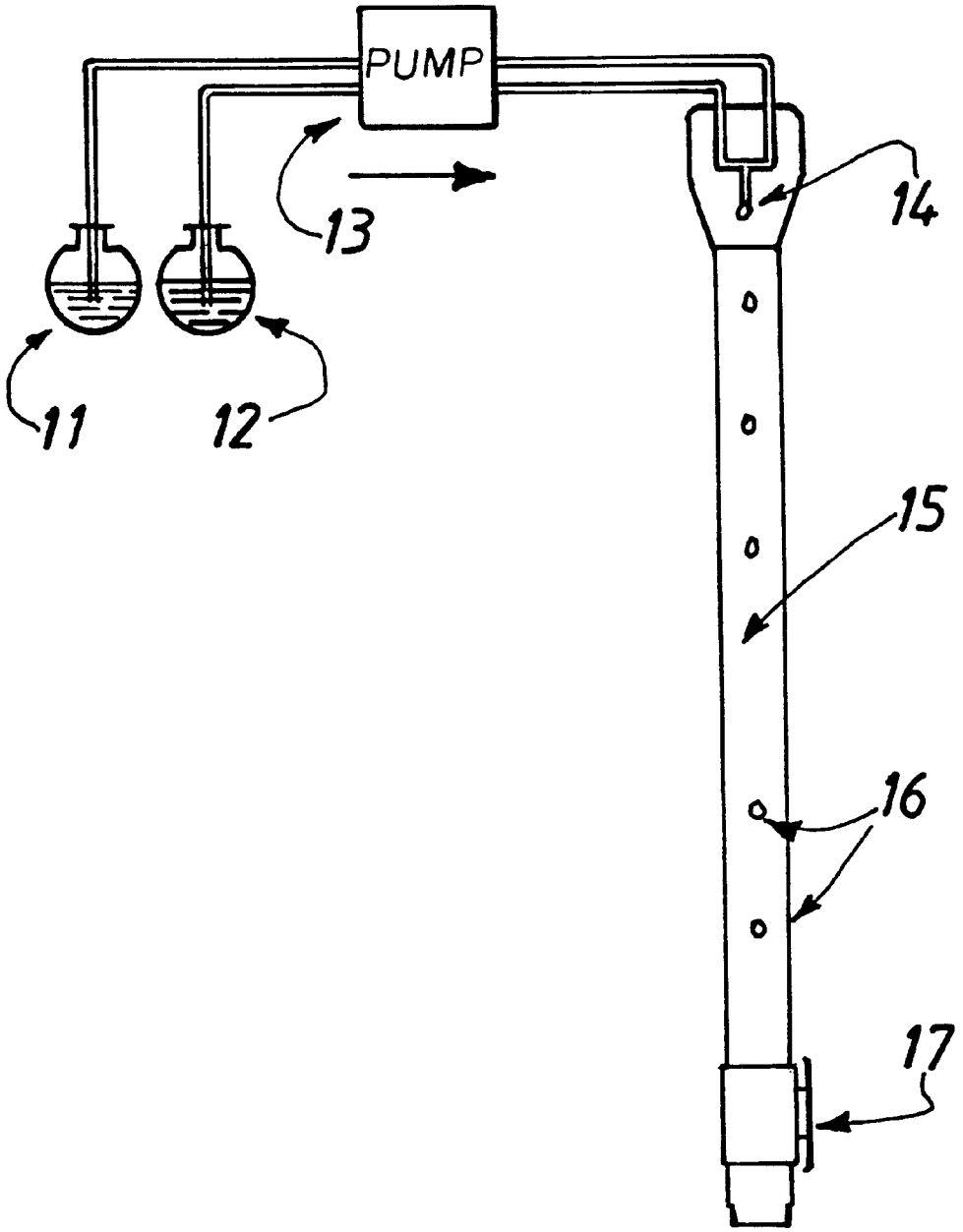
FIG. 1 is a schematic representation of device for the obtention of particles of a heat-reversible polymer to be used according to the invention.

In the context of the present invention, the terms "photographic effluent" or "standard photographic effluent" designate a spent (or "seasoned") photographic processing solution containing hydrophobic organic substances, in particular tars, and surfactants. The COD of these effluents is between 5 and 30 g/l, preferably between 10 and 20 g/l, measured according to the AFNOR standard NF T90-101.

Heat-reversible polymers used in accordance with this invention have structures and properties that vary according to the temperature, i.e., at a given temperature, they undergo a transition that modifies their affinity for hydrophilic or hydrophobic substances. These polymers, their preparation, their structure, their applications as systems for the release of active ingredients, have been described in the literature, in particular by T. Tanaka in Sc. Am., 1981, 244(1) 125 or R. Yoshida et al in Adv. Drug. Delivery Rev. 1993, II, 85.

The method of this invention allows the decontamination of a photographic effluent, in particular the removal of tars, through heat-reversible polymer particles. It was discovered that the heat-reversible polymer particles unexpectedly displayed a high stability during the successive heating-cooling cycles they were required to undergo to modify their hydrophobic/hydrophilic properties, despite the constraints caused by the confinement of water inside these particles. In addition, the heat-reversible polymer conserved a practically constant transition temperature in the presence of standard photographic effluent, despite the presence of surfactants.

The heat-reversible polymers used according to the invention advantageously contain moieties resulting from the polymerization of a monomer of formula:

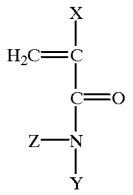

where X is H or $CH_3$; Z and Y each represent H or a straight-chain or branched alkyl group comprising from 1 to 6 atoms of carbon, a cycloalkyl group comprising from 3 to 7 atoms of carbon, or an aryl group comprising 6 to 10 atoms of carbon, or Z and Y can be combined with each other to form a nitrogen-containing heterocycle, provided that both Z and Y do not represent H.

In one embodiment, the heat-reversible polymer is a polymer or copolymer of N-alkyl-methacrylamide; or of N-alkylacrylamide, where alkyl represents a straight-chain or branched alkyl group comprising from 1 to about 6 atoms of carbon, such as methyl, ethyl, n-propyl, isopropyl, n-butyl, etc.

The polymers such as poly-N-alkylacrylamide used according to the invention must have a low lower critical solution temperature (LCST). Above this temperature, they are hydrophobic and contract in water. Below this temperature, they hydrate and become hydrophilic (hydrogels). By a low LCST is meant an LCST between 20 and 70° C., which, in addition, is not affected by the presence in the effluent of high inorganic salt concentrations, as occur in photographic effluents. Also, the polymers are stable at pH values of about 10 or more, which is the usual pH of most photographic effluents. The use of such polymers with photographic effluents is thereby much simplified.

One consequence of the above is also that the properties of the polymer may depend on the temperature at which the polymerization was carried out. If the polymerization was carried out at a temperature above the LCST, an opaque hydrophobic polymer is obtained. If the polymerization was carried out at a temperature below the LSCT, a transparent hydrogel (hydrophilic gel) is obtained. This transparent gel contracts when heated to above the LCST (about 35° C.) and becomes opaque and hydrophobic.

A poly(N-isopropylacrylamide) can for example be obtained in the following way, described by Tanaka and Fillmore in J. Chem. Phys. 70 (03), Feb. 1, 1979. A solution of monomer is made up in de-gassed water purified by reverse osmosis. To this solution is added a cross-linking agent such as N,N'-methylene bisacrylamide, or dihydroxyethylenebis-acrylamide, a polymerization initiator such as sodium or potassium persulfate, or 2,2-azobis-isobutyronitrile and an accelerator such as tetramethylethylenediamine, or ammonium peroxodisulfate or sodium metabisulfite. After a few minutes, a free-radical polymerization reaction yields the polymer. Preferred pairs of initiator-accelerator are known, such as sodium peroxodisulfate-tetramethylenediamine, or ammonium peroxodisulfate-sodium metabisulfite. These initiator-accelerator combinations allow the synthesis to be performed at a temperature below the LCST, and thereby to obtain the polymer directly in a hydrophilic form. In one embodiment, the monomer solution containing the accelerator, the initiator and the cross-linking agent are mixed and then dripped onto the surface of mineral oil contained in a vertical tube. The drops of solution fall by gravity down the tube of mineral oil and polymerize during their fall, forming a bead of polymer. The mixing and the polymerization are carried out away from air, in an inert atmosphere.

Such a polymerization can be performed with the device of FIG. 1.

This device comprises a round-bottomed flask 11 containing an aqueous solution of monomer to which has been added a cross-linking agent (for example N,N'-methylene-bisacrylamide) and a polymerization accelerator (for example, tetramethylethylenediamine), and a round-bottomed flask 12 contains an aqueous solution of polymerization inducer (for example ammonium persulfate). The solutions in flasks 11 and 12 are fed through a pump 13 to a T junction 14 where they mix, before dripping into column 15 filled with mineral oil, for example paraffin or silicone oil. The drops build up at the surface of the mineral oil before falling under gravity down column 15 giving polymer beads 16 as the polymerization takes place. The beads collect in the bottom 17 of the column, from which they can be retrieved. Flasks 11 and 12, pump 13, T 14 and the piping connecting them are all out of contact with the air, for example under argon atmosphere. The length of the column, its diameter and the pump flow rate are set so that the beads do not collide before they have finished polymerizing. The tube is preferably made of plastic, for example braided polyester coated with transparent PVC.

In one embodiment, the method of the invention can provide a porous gel, by adding a pore-inducing agent at the time of polymerization, or before it. Such pore-inducing agents are for example hydroxycellulose, cellulose, or chitin. Such pore-inducing agent are selected so that they do not inhibit the free-radical polymerization.

According to this invention, the polymer, when obtained by the method described above, is in the form of particles, preferably spherical, of diameter between about 0.2 and 20 mm, and advantageously between 2 and 10 mm. The polymer beads thus obtained can be washed with water at room temperature. In this form and at this temperature, the polymer beads are hydrophilic and retain about 80% of water. They can be submitted to several cycles comprising successive heating and cooling steps in a mineral oil bath to obtain polymer beads that are hydrophilic, but contracted and dehydrated. The beads can be stored in this form until they are used. The beads can then be rehydrated and placed in a container permeable to the effluent. The quantity of beads can represent from 10 to 1,000 g of dehydrated polymer, and advantageously, from 50 to 500 g per liter of effluent batch to be treated. In this bead form, the polymer adequately resists mechanical constraints and so can tolerate more numerous absorption-regeneration cycles. In addition, the beads can be placed in an easily handled cartridge. If the effluent is fed into the cartridge at a temperature above the LCST of the polymer, the polymer is hydrophobic, and traps organic substances. When the polymer is saturated, it can be cooled to ambient temperature, preferably by immersing it in cold mineral oil, or an equivalent hydrophobic liquid (for example a paraffin), to release the trapped substances. After washing with water, the polymer is ready for the next treatment cycle. The saturation point of the polymer can be stated in the operating instructions, according to the characteristics of the polymer and the effluent it is designed for. In practice, an embodiment of the invention can consist in placing the polymer beads in a cartridge placed in turn in the housing of one of the pumps, appropriately modified, in the processing solution circulation. Two cartridges can be installed in the housing so that one can be used while the other is being regenerated.

EXAMPLE

A porous polyisopropylacrylamide gel was prepared by the following procedure, using the device depicted in FIG. 1. The cross-linking agent was N,N'-methylenebisacrylamide, the polymerization initiator was ammonium persulfate, the accelerator was tetramethylethylenediamine. In the flask 11, 20 ml of de-gassed water purified by reverses osmosis, 3.2 g of N-isopropylacrylamide purified by crystallization in hexane, 0.06 g of N,N'-methylenebisacrylamide, and 0.054 g of tetramethylethylenediamine. Separately, a solution of 1.2 g of ammonium persulfate in 20 ml of osmosed and de-gassed water was prepared in flask 12. The flow rate of the pump was 1 ml/minute. The length of column 15 was 120 cm, and its internal diameter was 25 mm. Tube 15 was made of braided polyester coated with transparent PVC. The polymer was formed at the base of column 15, as opaque hydrogel beads. This polymer had an LCST below 35° C. Lastly, the beads were washed with pentane on a pumped filter funnel to remove the mineral oil, and then washed with water purified by reverse osmosis. They were stored in a plastic pill-box filled with water purified by reverse osmosis.

180 g of these hydrophilic polymer beads was taken and added to 300 ml of a bath that had the following composition:

| | |
|---|---|
| $Na_2SO_3$ | 4.5 g |
| $Na_2CO_3$ | 18.0 g |
| NaBr | 1.6 g |
| Solvent (1) | 2 mg |
| Water purified by reverse osmosis qsp | 1 l |
| pH | 11.5 |
| Temperature | 40° C. |

(1) solvent: di-n-butyl phthalate, to simulate the presence of an organic constituent.

The beads were left in contact with the bath for 1 h. At this temperature of 40° C., the beads became hydrophobic and absorbed the di-n-butyl phthalate. The beads were then removed from the bath and immersed in 100 ml of paraffin oil at 20° C. for 2 h. At this temperature, the beads became hydrophilic again, and released the di-n-butyl phthalate, which dissolved in the paraffin oil. The polymer beads were thus regenerated and made ready for a new treatment cycle. In this way 30 treatment cycles were accomplished. For each cycle, UV spectrophotometry (Perkin-Elmer UV/VIS/NIR Lambda 9 spectrophotometer) was used to measure the optical density and, by calibration, the quantity, of di-n-butyl phthalate in the paraffin oil, and this quantity was compared with the maximum theoretical quantity that the heat-reversible polymer could have accumulated after the number of cycles run. The results are given in Table I below.

TABLE I

| Number of cycles | Optical density at 230 nm | Quantity of solvent g/l | Theoretical quantity g/l |
|---|---|---|---|
| 9 | 7,86 × 10 − 4 | 0,05 | 0,06 |
| 11 | 8,58 × 10 − 4 | 0,05 | 0,07 |
| 12 | 1,42 × 10 − 3 | 0,08 | 0,08 |
| 15 | 2,1 × 10 − 3 | 0,1 | 0,1 |
| 30 | 3,5 × 10 − 3 | 0,2 | 0,2 |

The efficiency of the heat-reversible polymer was found to be maintained with increasing number of cycles. A calibration was used to correlate the optical density and the real quantity of solvent.

The invention has been described in detail with particular reference to certain preferred embodiments, but it will be understood that variations and modifications can be effected within the spilit and scope of the invention.

I claim:

1. A method for decontaminating an aqueous photographic processing bath by eliminating from said bath hydrophobic substances contained therein, said method comprising the steps of:

(1) placing the bath in contact with particles of a heat-reversible polymer that is hydrophobic at the temperature of the bath, and (2) separating the hydrophobic polymer from said processing bath, wherein the particles of the polymer have a mean diameter of from 0.2 to 20 mm.

2. The method of claim 1, wherein after step (2) the polymer is cooled to the temperature at which it reverts to its hydrophilic state and releases the hydrophobic substances that it had absorbed in step (1).

3. The method of claim 2, wherein steps (1) and (2) are repeated at least once.

4. The method of claim 1, wherein step (1) is carried out at a temperature between 30° C. and 60° C.

5. The method of claim 2, wherein after step (2), the polymer is cooled to room temperature.

6. The method of claim 1, wherein the polymer is a polymer or a homocopolymer of N-alkylacrylamide or N-alkyl-methacrylamide, where the alkyl group comprises from 1 to 6 atoms of carbon.

7. The method of claim 6, wherein the polymer is a cross-linked polymer.

8. The method according of claim 6, wherein the polymer is a N-isopropylacrylamide polymer.

9. The method of claim 8, wherein the particles have a mean diameter of from 0.4 to 0.8 mm.

* * * * *